US008029625B2

(12) United States Patent
Geissler et al.

(10) Patent No.: US 8,029,625 B2
(45) Date of Patent: Oct. 4, 2011

(54) METHOD AND DEVICE FOR THE SIMULTANEOUS CLEANING OF A PLURALITY OF PIPE CONDUITS OR PIPE CONDUIT SYSTEMS

(75) Inventors: Hanno Geissler, Krefeld (DE); Werner Peters, Julich (DE); Wolfram Peters, Bergheim (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 318 days.

(21) Appl. No.: 12/118,120

(22) Filed: May 9, 2008

(65) Prior Publication Data

US 2009/0000647 A1 Jan. 1, 2009

(30) Foreign Application Priority Data

May 11, 2007 (DE) ..... 10 2007 022 798

(51) Int. Cl.
*B08B 9/027* (2006.01)

(52) U.S. Cl. ..... 134/22.11; 134/22.12; 134/166 C; 134/171

(58) Field of Classification Search ..... 134/22.1, 134/22.11, 42, 60, 61, 166 R, 166 C, 171, 134/22.12

See application file for complete search history.

(56) References Cited

U.S. PATENT DOCUMENTS

| | | | | |
|---|---|---|---|---|
| 3,448,745 | A * | 6/1969 | Seeley | 134/103.1 |
| 6,227,215 | B1 * | 5/2001 | Akazawa | 134/169 C |
| 2004/0187897 | A1 | 9/2004 | Kenowski et al. | |
| 2004/0216779 | A1 | 11/2004 | Targosz et al. | |

FOREIGN PATENT DOCUMENTS

| | | | |
|---|---|---|---|
| DE | 3809473 | A1 | 10/1988 |
| WO | 01/38218 | A1 | 5/2001 |

* cited by examiner

*Primary Examiner* — Michael Barr
*Assistant Examiner* — Saeed T Chaudhry
(74) *Attorney, Agent, or Firm* — The Webb Law Firm

(57) ABSTRACT

Illustrated and described are a method and a device for the simultaneous cleaning of a plurality of pipe conduits or pipe conduit systems, particularly in each case having different pipe cross sections, wherein the cleaning takes place with a liquid cleaning medium, which is taken from a reservoir by a feed pump and fed to the systems to be cleaned. The invention makes provision for the cleaning medium stream to be fed to the first system to be cleaned and after leaving the first system to be cleaned, as cleaning medium stream, to be divided into two component streams, one component stream of which is used for cleaning the second or further system and the other component stream is again fed to the reservoir. In addition the second or further system to be cleaned is assigned a feed pump, whose speed and direction of rotation are variable for determining or regulating the cleaning method.

16 Claims, 4 Drawing Sheets

METHOD AND DEVICE FOR THE SIMULTANEOUS CLEANING OF A PLURALITY OF PIPE CONDUITS OR PIPE CONDUIT SYSTEMS

BACKGROUND OF THE INVENTION

1. Field of the Invention

The invention relates to a method for the simultaneous cleaning of a plurality of pipe conduits or pipe conduit systems, particularly in each case having different pipe cross sections, wherein the cleaning takes place with a liquid cleaning medium, which is taken from a reservoir by means of a feed pump and fed to the systems to be cleaned, as well as to a device for carrying out such a method.

2. Description of Related Art

In this case use is made of the well-known method of "CIP", that is to say "Cleaning in Place". CIP for cleaning pipe systems has long been the prior art for several decades for cleaning food-filling equipment for example. Although food-filling equipment or filling machines for short are mentioned below, the present invention is not to be limited, in any way, to just these machines, so that any pipe conduits or pipe conduit systems can be cleaned with the method according to the invention.

It is characteristic in this case for various cleaning media from a decentralized supply unit (in brief: CIP equipment) to be mixed, maintained at the right temperature and kept at the ready, in order whenever there is a cleaning requirement to transport the required medium by means of a pump and a pipe conduit system to the system to be cleaned.

Early CIP equipment supplied the cleaning media (temperature and concentration) on demand for the system to be cleaned in a fixed sequence and duration, which was determined by a program stored in the CIP equipment.

The cleaning medium during the cleaning process was pumped through the system to be cleaned, then, however, drained into the sewers. This method is called "lost" cleaning, since the cleaning medium is not recycled.

In order to achieve environmentally friendly and economic production processes, so-called CIP re-circulation cleaning with "stacking" of cleaning solutions was developed, wherein the cleaning media (usually caustic and/or acid solutions) were returned to the CIP via pipes and re-used there for as long a time as the cleaning strength was sufficient.

The well-known methods of the CIP equipment, however, could be improved:

- The flow-rate (mechanics) of the cleaning solution supplied depends on the capacity of the CIP pump, the dimension of the supply pipe and the conduit length between CIP equipment and filling machine. Therefore in practice flow-rates of between 10 and 15 $m^3/h$ are used.
- This flow-mechanics factor greatly affects the cleaning result, therefore the quantity supplied is often too little, depending on the tank sizes and pipe cross sections used in filling machines, and a satisfactory cleaning result is only achieved by means of a long cleaning period, since the flow-rate (and therefore the cleaning efficiency) is greatly reduced in the case of large diameters.
- Often rotating balls are used in tanks, which are designed to exert extra mechanical cleaning force on the tank surfaces. This solution, however, carries aseptic risks and cannot be used in the case of so-called reverse cleaning (reversal of the direction of flow during cleaning), since there is a danger that lumpy products will not be completely removed.

- In principle only one filling system can be cleaned via a pipe system at the same time, unless two filling machines undergo the same cleaning steps simultaneously. However, if two filling systems are designed for different products (here water and products with lumps), there is the danger that lumps from the other filling system ingress the filling system, which is dimensioned (smaller) for water and clog this up.
- Also, in the case of the larger dimensioned filling system higher flow-rates are needed than is the case for the water filling system, in order to achieve a similar cleaning result in the same period.
- Therefore, up to now it has been necessary, when these two different filling systems are used, to connect two separate CIP pipes to two separate pumps in order to be able to clean the systems commensurate with the product at the same time.

SUMMARY OF THE INVENTION

The object of the invention, therefore, is to configure and further refine the method specified initially and described above in detail, as well as a corresponding device for cleaning pipes, so that the quantity of the necessary cleaning medium and the cleaning period can be minimized without compromising the aseptic conditions.

As regards the method, the object is achieved according to a first solution in that the cleaning medium stream is fed to the first system to be cleaned and after leaving the first system to be cleaned is divided into two component streams, one component stream of which is used for cleaning the second or further system and the other component stream is again fed to the reservoir.

Alternatively, the object is solved by a method wherein the cleaning medium stream is firstly fed to the second or further system to be cleaned and only thereafter is divided into component streams, one of which is again added to the second component stream and the other is again fed to the reservoir.

Further alternatively, it is provided for that the cleaning medium stream is firstly divided into two component streams, the first of which is again fed to the reservoir and the second cleaning medium stream is firstly divided into component streams, one of which is fed to the second or further system to be cleaned and the other is again fed to the reservoir.

These alternative modes of operation are particularly advantageous since they can be achieved in alternation without constructional expansion or technical circuit complexity. Because, in a further embodiment of the invention, the second or further system to be cleaned is assigned a feed pump, whose direction of rotation only has to be reversed in order to select the two alternative methods described.

A corresponding device according to the invention is characterized in that the second or further system to be cleaned is assigned a feed pump, whose speed and direction of rotation are variable for defining or regulating the cleaning process, in that the pipe for the first component stream is constructed as a pressure holding unit, and in that a throttle valve is arranged in the return pipe of the component streams.

In accordance with a further preferred teaching of the invention the speed of this pump and thus the flow-rate of the cleaning medium are variable in both directions, in order to be able to achieve optimum cleaning efficiency.

It is particularly advantageous if the feed pump assigned to the second or further system to be cleaned can be used both for transporting the cleaning medium and for transporting the product. This is particularly advantageous, since—in reverse—particularly if a device according to the invention is retrofitted an already existing feed pump can be used for the cleaning process.

Advantageously, the flow-rate of cleaning medium is controlled by regulating the speed of the two pumps in the CIP equipment and the system to be cleaned.

A further teaching of the invention makes provision for the cleaning medium stream, before entering the first system to be cleaned, to be firstly divided into two component streams, the first of which is returned to the reservoir and the second is fed to the first system to be cleaned. Thus direct re-circulation of the cleaning medium occurs here. By reducing the first component stream it is possible to influence the temperature, concentration or quantity of the cleaning medium for the main stream carrying out the cleaning of the systems.

The method according to the invention in this case is particularly economic with regard to the cleaning medium, since the divided first component stream can be used (again) if there is a shortage of cleaning medium in the systems to be cleaned for refilling the cleaning system.

Advantageously, the strength (caustic solution/acid concentration) of the cleaning medium is adjustable.

It goes without saying that the CIP equipment can be equipped with a plurality of reservoirs for different cleaning media. This is sufficiently known from the prior art and is therefore to apply accordingly for the method according to the invention or the corresponding device, without detailed reference having to be made thereto.

The device according to the invention can be used also and particularly if the pipe cross-sections of the systems to be cleaned have various sizes. As a result of the pipe circuit according to the invention two or more systems with different flow-rates or nominal sizes can be cleaned simultaneously, irrespective of the discharge rate of the feed pump of the CIP equipment.

Preferably, the device according to the invention has sensors to meter the flow-rates and/or for measuring temperature or conductance. 'Conductance' is understood to mean the acid/caustic solution concentration of the cleaning medium.

The following advantages result according to the invention;

- Higher mechanical cleaning force at reduced pressure
- Independence to a large extent from the quantity of CIP cleaning medium supplied
- Independence from the inertia of the CIP cleaning medium in the pipe between CIP equipment and filling machine
- Avoidance of pressure surges when the valve positions change or when the direction of flow is reversed
- Cleaning medium from the system with large nominal size does not get into the system with small nominal size
- Simultaneous use of the pump as a cleaning and aseptic product feed pump
- Automatic temperature adjustment and monitoring of the medium (caustic solution/acid concentration in the cleaning systems)
- Flow control by regulating the pump speed.

BRIEF DESCRIPTION OF THE DRAWINGS

The invention is described below in detail on the basis of a drawing illustrating simply advantageous exemplary embodiments. In the drawing there are shown.

DETAILED DESCRIPTION OF THE INVENTION

It is pointed out that in all figures the pipes are only illustrated as lines, the arrows indicating the flow direction of the cleaning medium.

Figure 1:
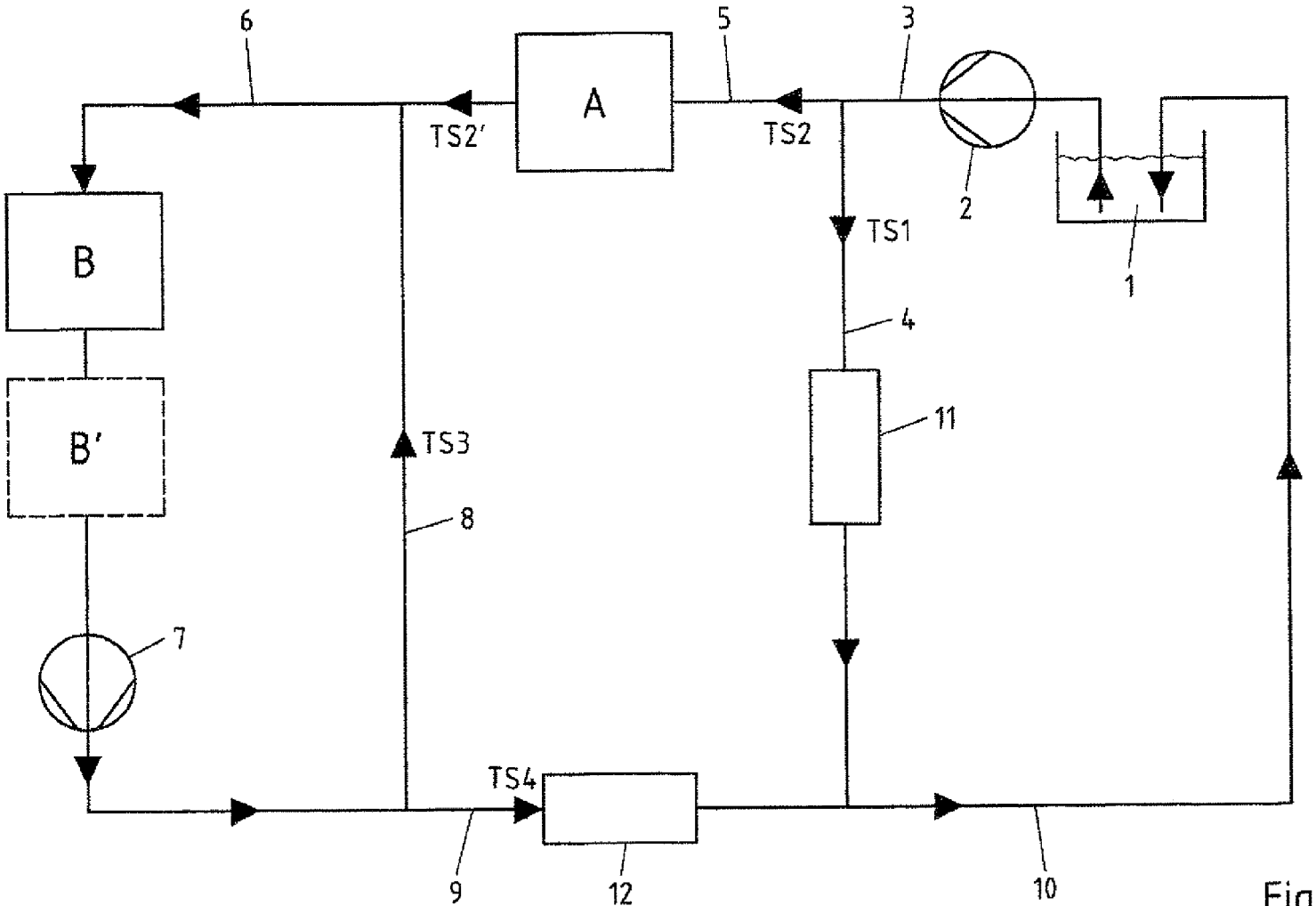
FIG. 1 the functional principle of the method according to the invention in a basic flow-chart (first alternative), FIG. 2 the functional principle of the method according to the invention in a basic flow-chart (second alternative), FIG. 3 the flow-chart from FIG. 1, supplemented by exemplary flow-rates and FIG. 4 the flow-chart from FIG. 2, supplemented by exemplary flow-rates.

FIG. 1 shows how a cleaning medium is transported from the CIP equipment having at least one reservoir 1 and a feed pump 2 via the supply pipe 3 towards sub-system A. A component stream TS1 is fed back into the return pipe to the CIP equipment via a bypass 4. This stream is used for refilling if there is a shortage of medium in the sub-systems.

Component stream TS3 via the pipe 8, which serves here as a bypass, is returned to the pipe 6 between sub-system A and sub-system B (internal re-circulation). Component stream TS4 flows back via a throttle valve 12 to the CIP equipment. This quantity, which leaves the sub-systems A, B or B', decides the quantity of fresh cleaning medium to be fed into the sub-systems A, B or B' from the CIP equipment. The remaining component stream TS2 via a pipe 5 reaches the sub-system to be cleaned A and from there as component stream TS2' via a pipe 6 further reaches the sub-system B. A broken line indicates that there may be further sub-systems B' to be cleaned apart from the sub-system B. A feed pump 7 arranged in the region of the sub-systems B, B' ensures the necessary flow of the cleaning medium, assisted by the feed pump 2 of the CIP equipment. This main cleaning flow TS2' is accelerated or retarded by the integral feed pump 7 and divided once again (component streams TS3 and TS4).

In the first exemplary embodiment according to FIG. 1 the component stream TS2' before entering the sub-system B is combined with the further component stream TS3 having already flowed through this system, which via a pipe 8 is again fed to the pipe 6. A previously divided quantity of the cleaning medium via the pipes 9 and 10 is again fed to the reservoir 1 as component stream TS4. In order to ensure stable pressure distribution, a pressure holding unit 11 is provided in the pipe 4 and a throttle valve in the pipe 12.

It is quickly evident that the two sub-systems A and B can have different nominal sizes. Due to the fact that although the component stream TS2', having already left the sub-system A, can enter the sub-system B or B', the reverse case is impossible, it is reliably prevented that lumpy material present in the pipes with larger nominal size of the sub-system B or B' can reach the sub-system A and lead to blockages there.

Figure 2:
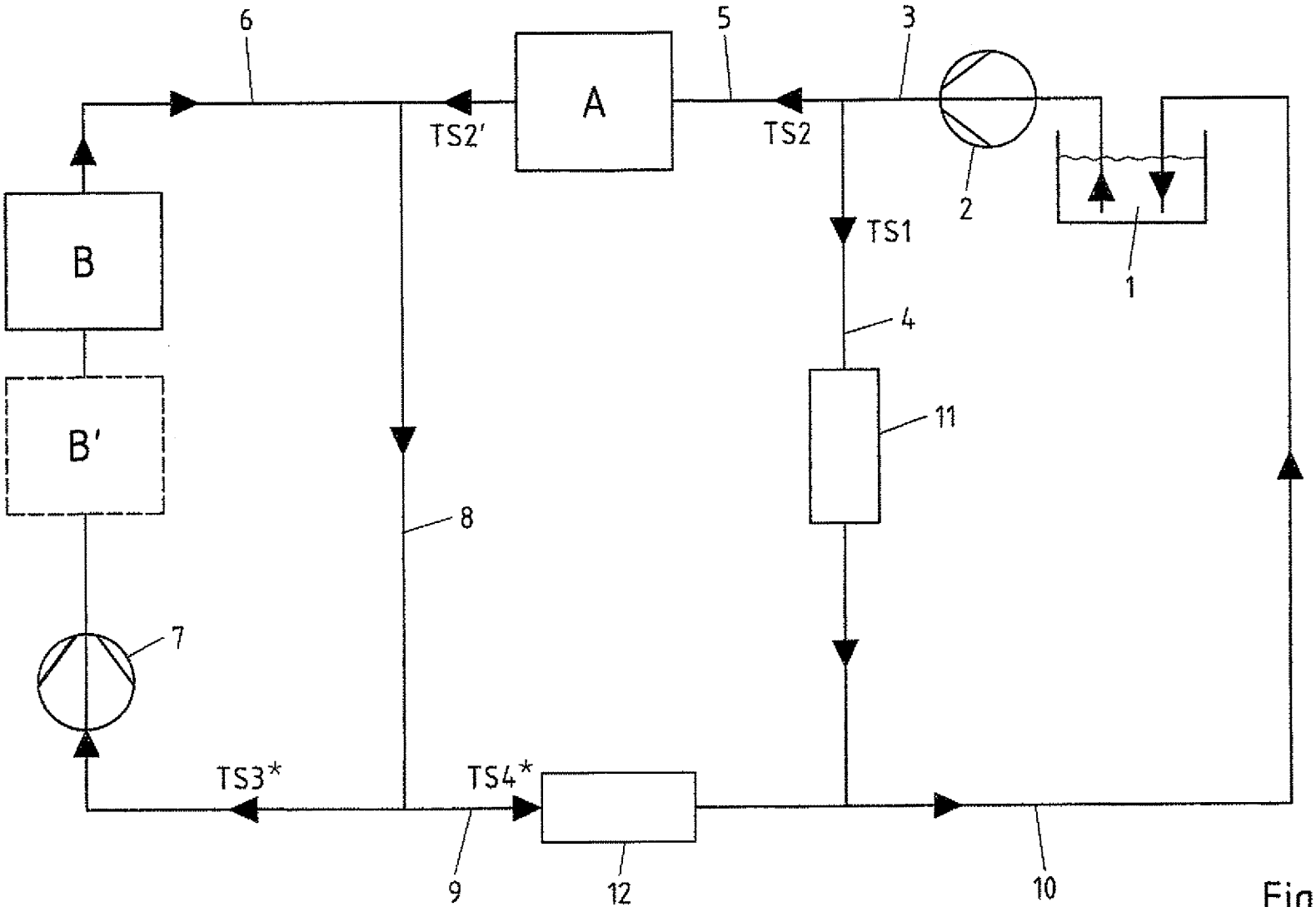

The same applies to the alternative mode of operation, which is illustrated in FIG. 2. Here, the component stream TS2 leaves the sub-system to be cleaned A as component stream TS2' and is fed via the pipe 8 and then once again divided into the component streams TS3* and TS4*. The component stream TS3* is used for cleaning the sub-systems B (or already previously B') and the component stream TS4* is again fed to the reservoir 1.

After leaving sub-systems to be cleaned B or B' the component stream TS3* via the pipe 6 is again added to the component stream TS2'.

By comparing the two principle flow-charts from FIG. 1 and FIG. 2 it quickly becomes clear that the alternative mode of operation is only achieved by changing the direction of rotation of the feed pump 7. There is no need for further technical circuit or constructional changes.

Figure 3:
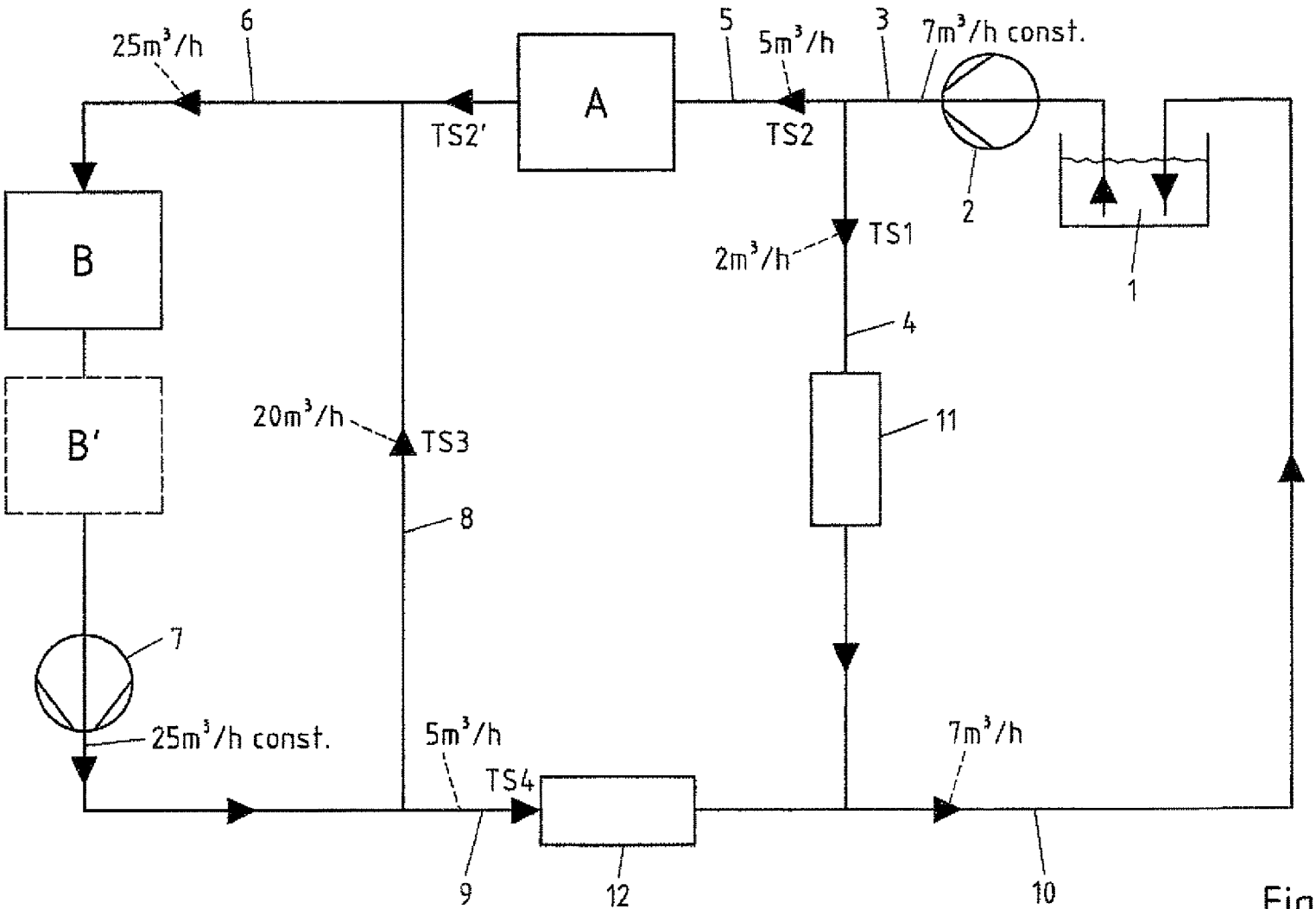
Figure 4:
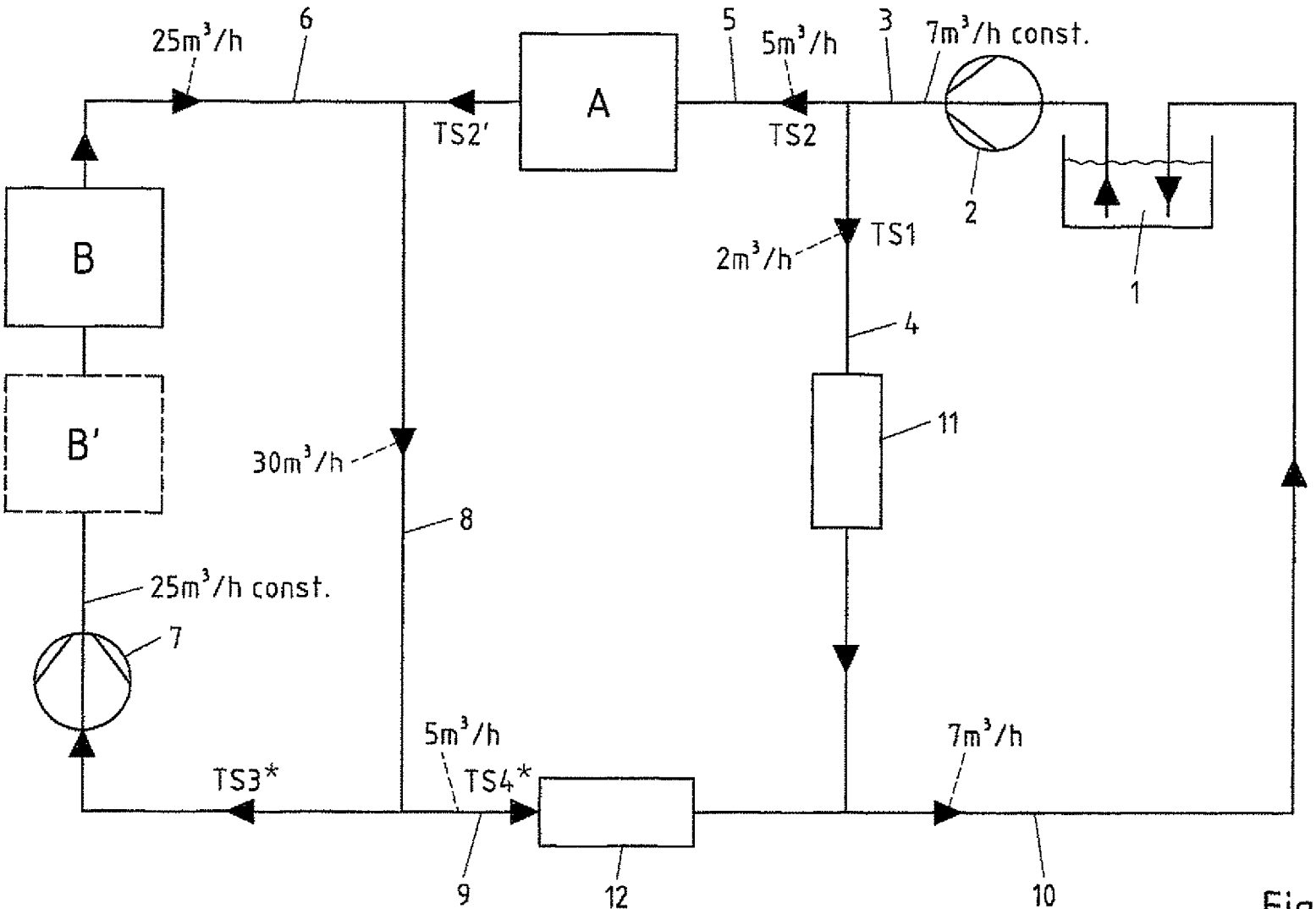

In terms of content FIGS. 3 and 4 are identical to FIGS. 1 and 2, wherein, however, for better understanding, the supply quantities are also shown at a rate of volume/time ($m^3/h$) for example.

The cleaning medium in the example illustrated leaves the feed pump 2 of the CIP equipment at a rate of 7 $m^3/h$ (both alternatives) and after the first division is transported further as component stream TS1 at a rate of 2 $m^3/h$ and as component stream TS2 at a rate of 5 $m^3/h$.

In the case of the flow-chart in accordance with FIG. 3, a further component stream TS3 (20 $m^3/h$) of the cleaning medium, having already flowed through the sub-systems B and possibly B', is introduced into the component stream TS2' (5 $m^3/h$), so that there results a total flow-rate of 25 $m^3/h$ introduced into the sub-systems B and possibly B'. The feed pump 7 ensures constant movement of the rate of 25 $m^3/h$ of the example illustrated.

As previously mentioned the stream is divided underneath the feed pump 7 into the component streams TS3 (20 $m^3/h$) and TS4 (5 $m^3/h$), wherein the component stream TS4 (5 $m^3/h$) together with the component stream TS1 (2 $m^3/h$) comprising a quantity of cleaning medium at a rate of 7 $m^3/h$ is fed to the CIP equipment.

This is different in the alternative illustration of FIG. 4, wherein the direction of rotation of the feed pump 7 has been reversed. Here, the component stream TS2' after passing through the sub-system A still at a rate of 5 $m^3/h$ is combined with the component stream TS3* (25 $m^3/h$), so that a total flow-rate of 30 $m^3/h$ results. This stream again divides into the two component streams TS3* at a rate of 25 $m^3/h$ and TS4* at a rate of 5 $m^3/h$. The component stream TS4* is then combined with the component stream TS1, so that both are again returned to the reservoir 1 together at a rate of 7 $m^3/h$.

In both FIGS. 3 and 4, in the example illustrated, the feed pumps 2 run constantly at a rate of 7 $m^3/h$ and feed pump 7 at a rate of 25 $m^3/h$. It is clear that varying the speed of the feed pump 7 causes corresponding changes in the volume of the cleaning medium transported. In this way optimum cleaning conditions can be achieved in an optimized shortest cleaning period.

The invention claimed is:

1. A method for cleaning a plurality of pipe conduits or pipe conduit systems, wherein the cleaning takes place with a liquid cleaning medium, which is taken from a reservoir by a reservoir feed pump and fed to the systems to be cleaned, wherein a cleaning medium stream is fed to a first system to be cleaned and after leaving the first system to be cleaned, the cleaning medium stream is divided into two component streams, one component stream of which is used for cleaning a second or further system and the other component stream of which is fed to the reservoir.

2. A method for cleaning a plurality of pipe conduits or pipe conduit systems, wherein the cleaning takes place with a liquid cleaning medium, which is taken from a reservoir by a reservoir feed pump and fed to the systems to be cleaned, wherein a cleaning medium stream is firstly fed to a first system to be cleaned and only thereafter is divided into first and second component streams, the first component stream of which is added to the cleaning medium stream and the second component stream of which is fed to the reservoir.

3. The method according to claim 1, wherein the cleaning medium stream is firstly divided into a first and second component stream, the first component stream of which is fed to the first system to be cleaned and the second component stream of which is fed to the reservoir.

4. The method according to claim 1, wherein the second or further system to be cleaned is assigned a second system feed pump, and the second system feed pump is operational in a first direction and a second direction.

5. The method according to claim 4, wherein the speed of the second system feed pump is variable in the first direction and the second direction.

6. The method according to claim 4, wherein the second system feed pump can be used both for transporting the cleaning medium and for transporting a product in the second or further system.

7. The method according to claim 4, wherein the flow-rate of the cleaning medium is controlled by regulating the speed of the feed pumps.

8. The method according to claim 1, wherein the cleaning medium stream, prior to being fed to the first system to be cleaned, is divided into a first and second component stream, the first of which is fed to the reservoir and the second of which is fed to the first system to be cleaned.

9. The method according to claim 8, wherein the first component stream is reduced in flow-rate in order to influence the temperature, concentration or quantity of the cleaning medium in the systems to be cleaned.

10. The method according to claim 1, wherein a solution concentration strength of the cleaning medium is adjustable.

11. A device for executing the method according to claim 8, the device comprising:

the reservoir and the reservoir feed pipe are coupled to the first system to be cleaned by a first pipe;

a second system feed pump, whose speed and direction of rotation are variable for defining or regulating a cleaning method, assigned to the second or further system to be cleaned;

a second pipe coupled to the first pipe for directing the first component stream back to the reservoir, the second pipe is constructed as a pressure holding unit; and a throttle valve is arranged in a return pipe of at least one of the component streams.

12. The device according to claim 11, wherein the pipe cross sections of the systems to be cleaned have various sizes.

13. The device according to claim 11, wherein metering of the flow-rates is provided at least in the region of the feed pumps.

14. The device according to claim 11, wherein sensors for measuring temperature are provided at least in the region of the feed pumps.

15. The device according to claim 11, wherein sensors for measuring conductance are provided at least in the region of the feed pumps.

16. A method for the cleaning of a plurality of pipe conduit systems, the plurality of pipe conduit systems includes at least a first system and a second system, the second system is assigned a second system feed pump, the second system feed pump is operational in a first direction and a second direction, and cleaning takes place with a liquid cleaning medium, the method comprising:

when the second system feed pump is operational in the first direction, feeding a cleaning medium stream from a reservoir by a reservoir feed pump to a first system to be cleaned;

dividing the cleaning medium stream into two component streams after leaving the first system to be cleaned, one component stream of which is used for cleaning a second or further system and the other component stream of which is fed to the reservoir;

when the second system feed pump is operational in the second direction, firstly feeding the cleaning medium stream from a reservoir by a reservoir feed pump to the second system to be cleaned; and only thereafter, dividing the cleaning medium stream into first and second component streams, the first component stream of which is added to the cleaning medium stream and the second component stream of which is fed to the reservoir.

* * * * *